US011325751B1

(12) United States Patent
Duong et al.

(10) Patent No.: US 11,325,751 B1
(45) **Date of Patent: *May 10, 2022**

(54) COSMETIC JAR WITH WINDOWED LID

(71) Applicant: Glam and Glits Nail Design, Inc., Bakersfield, CA (US)

(72) Inventors: Khoa Duong, Bakersfield, CA (US); Jianhua Weng, Flushing, NY (US)

(73) Assignee: Glam and Glits Nail Design, Inc., Bakersfield, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,893

(22) Filed: Aug. 11, 2020

Related U.S. Application Data

(63) Continuation of application No. 16/836,660, filed on Mar. 31, 2020, now Pat. No. 10,737,841.

(51) Int. Cl.

| | |
|---|---|
| ***A45D 33/18*** | (2006.01) |
| ***B65D 25/54*** | (2006.01) |
| ***B65D 43/02*** | (2006.01) |

(52) U.S. Cl.
CPC ..... *B65D 25/54* (2013.01); *A45D 33/18* (2013.01); *B65D 43/0231* (2013.01); *A45D 2200/052* (2013.01); *B65D 2203/02* (2013.01)

(58) Field of Classification Search
CPC ..... A45C 11/008; A45C 5/005; A45D 33/18; B65D 43/0231; B65D 2203/02; B65D 25/54; B65D 51/18
USPC ..... 206/581; 220/254.1
See application file for complete search history.

(56) References Cited

U.S. PATENT DOCUMENTS

| | | | |
|---|---|---|---|
| D271,180 | S | 11/1983 | Runyon |
| D405,699 | S | 2/1999 | Chae |
| 5,950,638 | A | 9/1999 | Crosta |
| D424,749 | S | 5/2000 | Zalzal |
| D445,032 | S | 7/2001 | Hammer |
| D448,299 | S | 9/2001 | Re |
| D484,644 | S | 12/2003 | Noh |
| D485,017 | S | 1/2004 | Noh |
| D498,678 | S | 11/2004 | Ames |
| D503,889 | S | 4/2005 | Yeung |
| D504,542 | S | 4/2005 | Noh |
| D517,733 | S | 3/2006 | Tsai |
| D525,136 | S | 7/2006 | Bakic |
| D532,556 | S | 11/2006 | Noh |

(Continued)

OTHER PUBLICATIONS www.beauty-makeup-supply.com cosmetic jars webpage,"Luxury Cosmetic Jars with Lids," Feb. 27, 2020—6 pages.

*Primary Examiner* — King M Chu
(74) *Attorney, Agent, or Firm* — Lapple Ubell IP Law, LLP; Matthew C. Lapple

(57) ABSTRACT

Embodiments described herein relate to a jar and lid combination with a jar body and a threadably-attachable jar lid, where the jar lid has a translucent window. Certain embodiments provide a structure for the windowed jar lid and jar body, so that the jar can contain fine powder without leakage, and without the need for a separate sealing layer adhered to the rim of the jar prior to securing the lid to the jar. Other embodiments relate to structures and methods for use by which a logo can be printed on the jar lid window, and then mechanically secured to the jar body, such that the logo is correctly aligned with the printed information on the front of the jar.

24 Claims, 14 Drawing Sheets

(56) References Cited

U.S. PATENT DOCUMENTS

| | | | |
|---|---|---|---|
| D540,170 | S | 4/2007 | Canamasas Puigbo |
| D543,458 | S | 5/2007 | Dittmer et al. |
| D555,835 | S | 11/2007 | Song |
| D574,710 | S | 8/2008 | Gangrade |
| D577,290 | S | 9/2008 | Moretti |
| D581,279 | S | 11/2008 | Oates |
| D582,283 | S | 12/2008 | O'Donahue |
| D582,291 | S | 12/2008 | de Baschmakoff |
| D593,372 | S | 6/2009 | Carreno |
| D610,460 | S | 2/2010 | Nagata |
| D611,354 | S | 3/2010 | Usui et al. |
| D613,603 | S | 4/2010 | Rowland et al. |
| D615,868 | S | 5/2010 | Rodriguez et al. |
| D621,261 | S | 8/2010 | DeMarco |
| D627,650 | S | 11/2010 | Yeung |
| D630,949 | S | 1/2011 | Lim |
| D640,925 | S | 7/2011 | Rodriguez et al. |
| D641,257 | S | 7/2011 | Thiebaut et al. |
| D645,749 | S | 9/2011 | Lee |
| D651,900 | S | 1/2012 | Ashiwa et al. |
| D659,004 | S | 5/2012 | McCoy |
| D674,698 | S | 1/2013 | Mongeon et al. |
| D676,324 | S | 2/2013 | DeMarco |
| D691,888 | S | 10/2013 | Mettler et al. |
| D697,800 | S | 1/2014 | Villarreal et al. |
| D697,806 | S | 1/2014 | In |
| D703,055 | S | 4/2014 | Park |
| 8,870,011 | B2 | 10/2014 | Hammer et al. |
| D728,372 | S | 5/2015 | Behar et al. |
| D731,891 | S | 6/2015 | Servaire |
| D733,967 | S | 7/2015 | Schlatter |
| D736,643 | S | 8/2015 | Mettler et al. |
| D739,741 | S | 9/2015 | Staab |
| D743,797 | S | 11/2015 | Delagrange |
| D744,293 | S | 12/2015 | Linder |
| D746,627 | S | 1/2016 | Puigbo |
| D748,976 | S | 2/2016 | Mitchell |
| D755,051 | S | 5/2016 | Otani et al. |
| D756,226 | S | 5/2016 | In et al. |
| D765,512 | S | 9/2016 | Joulia |
| D776,524 | S | 1/2017 | Albano et al. |
| D781,151 | S | 3/2017 | Lerman |
| D787,895 | S | 5/2017 | Kilduff et al. |
| D789,794 | S | 6/2017 | Kim |
| D792,223 | S | 7/2017 | Kim |
| D795,705 | S | 8/2017 | Huang |
| D796,329 | S | 9/2017 | Burditt, Jr. et al. |
| D803,060 | S | 11/2017 | Marina et al. |
| D807,748 | S | 1/2018 | Bauchwitz |
| D816,505 | S | 5/2018 | Percassi |
| D821,216 | S | 6/2018 | Weinrich |
| D835,508 | S | 12/2018 | Burrowes et al. |
| D837,651 | S | 1/2019 | Jeong |
| D840,235 | S | 2/2019 | Komai et al. |
| D842,700 | S | 3/2019 | Blomberg et al. |
| D843,835 | S | 3/2019 | Staab |
| D845,129 | S | 4/2019 | Lee |
| D845,136 | S | 4/2019 | Mateus et al. |
| D847,645 | S | 5/2019 | Lee |
| D855,466 | S | 8/2019 | Chen et al. |
| D865,529 | S | 11/2019 | Tidwell et al. |
| D867,155 | S | 11/2019 | Oishi |
| 2004/0003825 | A1* | 1/2004 | Kelly ..... A45D 33/008 132/301 |
| 2004/0069677 | A1* | 4/2004 | Baudin ..... A45D 40/0068 206/581 |

* cited by examiner

COSMETIC JAR WITH WINDOWED LID

CROSS-REFERENCE TO RELATED APPLICATIONS

This application is a continuation of U.S. patent application Ser. No. 16/836,660; filed on Mar. 31, 2020, and which is scheduled to be issued as U.S. Pat. No. 10,737,841 on Aug. 11, 2020, which is incorporated by reference herein in its entirety.

FIELD OF DISCLOSURE

Embodiments disclosed herein relate to the manufacturing and labeling of jars for consumer products, such as cosmetic powders, and particularly regarding jars with windowed jar lids.

BACKGROUND

It is often said that "people buy with their eyes." Beautiful and well-branded packaging can significantly enhance the desirability of goods, and promote improved sales of those goods. This is particularly true with respect to goods that might otherwise be viewed as mere commodities. Such products include, without limitation, the many different kinds of powders, creams and liquids that are used as cosmetics, manicure/pedicure products, and other spa treatment products.

It is generally believed by the Applicant that, when a cosmetic, manicure/pedicure product, or other spa treatment product is visually appealing, and can be presented to a customer at the time that the customer is deciding what goods or services to purchase, the customer is more likely to purchase the visually appealing product/service, and/or to purchase more products and services than the customer might otherwise buy when presented with only a written menu, an oral explanation of services, or product packaged in unattractive off-the-shelf jars. Thus offering a cosmetic, manicure/pedicure product, or spa treatment product in visually appealing packaging can enable a cosmetic store, a manicure/pedicure salon, or a spa owner to achieve higher sales.

On the other hand, it is generally believed by the Applicant that the contrary point is true—when products are packaged in a manner that is unattractive, sloppy, inconsistent, poorly-branded, "in bulk," or that shows a lack of attention to detail—this packaging can and does have a negative impact on consumer perception of the product, and a further negative impact on sales figures for that product.

Many cosmetics, manicure/pedicure products, and other spa treatment products are sold in small jars, containing between one and five fluid ounces of powder, cream or liquid. Such jars typically have a jar body, with a threaded neck, and a jar lid, with threads that engage with the threaded neck. Some such jars have a transparent or translucent jar body, to allow consumers to see the cream, powder or liquid inside the jar. This approach is sometimes used for packaging of powdered acrylic for use on artificial nail treatments.

However, for many such products, particularly in the nail industry, the industry standard manner of display is to place the jars in a large stand, or rack, with jars containing product of each color in a separate slot in the rack. One drawback associated with this approach is that when jars have an opaque lid, it can be difficult for consumers to quickly identify the color or colors of product that they want, especially for cosmetic brands that have dozens of different colors. Another drawback of opaque lids are that, when many jars of nail powder are stored by a manicurist in a drawer, or a box, it can be difficult for the manicurist to quickly locate the jar with the color of powder she prefers.

Some cosmetics producers have offered cosmetic powder packaged in jars that have completely transparent lids. While such a prior art solution has value, it limits packaging solutions for cosmetics manufacturers that want to have a particular appearance of their products that includes a lid with an opaque, colored exterior ring, and a "window" bounded by the ring.

Some have offered cosmetic powder packaged in jars that have a "window" in the lid, allowing the color of the cosmetic powder to be visible from the top of the jar. A drawback of this approach is that currently available windowed jar lids often leak when used with fine grains of cosmetic powder, such as acrylic nail dipping powder.

Some prior art solutions to the leakage problem use a sealing layer on the jar, inside of the lid. Such sealing layers are variously made of metallic foil or plastic. However, use of such a sealing layer spoils the effect of having a transparent window in the lid. Further, use of a sealing layer results in the need for another packaging step—applying the sealing layer with a heat treatment before putting on the threaded lid. Still further use of a sealing layer results in wasteful packaging and customer frustration in the need to break or rip off the film seal prior to use.

Another drawback is that if a brand wants to have the window printed with the brand logo, it is difficult to ensure that the logo will be lined up and correctly oriented with the front of the jar. In other words, current manufacturing processes often result in inconsistent labeling of the window, resulting in "crooked" logos when the lid is rotatably screwed into place, when the logo is compared to the orientation of the product name on the front of the jar. Currently, this issue is addressed by hand printing logos on jar lids after closure, or by using stickers that are adhered to the jar lid and/or front of the jar, generally after closure. However, hand printing, hand assembly, or hand-stickering all result in inconsistent products and high labor costs.

Accordingly, there is an unfulfilled need for a windowed jar lid that threadably attaches to a jar body, where the combination of the windowed jar lid and the jar body is capable of holding fine cosmetic powders without leaking through the threaded closure or the window edges, and without using a separate sealing film or foil. Further, there is a need for a windowed jar lid that threadably attaches to a jar body, and a method of making same, so that a logo printed on the windowed jar lid will be properly aligned with information on the front of the jar when the jar lid is threadably attached to the jar body.

SUMMARY OF THE INVENTION

The various embodiments of the present windowed jar lid and jar has several features, no single one of which is solely responsible for its desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments solve the problems discussed in the Background and provide the advantages described herein.

In a first aspect, a jar and lid combination comprises a jar body, where the jar body has a neck with a first set of threads and a jar body rim, and a jar lid comprising a ring with a vertical portion and a horizontal portion, where the vertical portion has an interior surface with a second set of threads, a liner, placed in contact with an interior surface of the horizontal portion, and positioned radially inward of the vertical portion, an interior wall, projecting downwardly from the horizontal portion and positioned radially inward of the liner, where the interior wall has a rim, an interior edge, positioned radially inward of the interior wall, where the interior edge forms an aperture in the horizontal surface, a window pane, at least a portion of which is comprised of a translucent material, where the window pane is affixed to the horizontal portion, such that the window pane obstructs the aperture and will prevent powder from passing through any portion of the aperture, where the jar lid may be secured to the jar neck by engagement of the first set of threads and the second set of threads, until the liner is securely contacted by the jar rim and the rim of the interior wall is positioned below the jar rim.

In an embodiment of the first aspect, the window pane is comprised of a transparent material.

In another embodiment of the first aspect, the jar body is comprised of a transparent material.

In another embodiment of the first aspect, the jar body is comprised of acrylonitrile styrene ("AS"), and the wherein the window pane is comprised of AS.

In another embodiment of the first aspect, the horizontal portion of the jar lid further comprises a ledge positioned radially inward of the interior wall, and wherein the window pane is affixed to the ledge.

In another embodiment of the first aspect, the aperture is generally circular, the window pane is generally circular, the interior wall is generally annular, and the liner is generally annular.

In another embodiment of the first aspect, the aperture is generally oval and the window pane is generally oval.

In another embodiment of the first aspect, the window is affixed to the interior surface by a laser weld.

In another embodiment of the first aspect, the window is affixed to the interior surface by an adhesive.

In another embodiment of the first aspect, the liner is comprised of paper.

In another embodiment of the first aspect, the liner is comprised of polyethylene.

In another embodiment of the first aspect, wherein the liner is comprised of low density polyethylene foam.

In another embodiment of the first aspect, the window pane has a circumference, the aperture has a circumference, and wherein the circumference of the window pane is larger than the circumference of the aperture.

In another embodiment of the first aspect, the combination does not include a sealing layer covering the jar between the jar rim and the jar lid.

In another embodiment of the first aspect, the jar body has an interior volume of between about 0.5 fluid ounces and 5 fluid ounces.

In another embodiment of the first aspect, the dimensions of the jar neck comprise a "T" dimension of about 51.29 mm, an "E" dimension of about 49.6 mm, an "I" dimension of about 46.39 mm, an "S" dimension of about 1.45 mm; an "H" dimension of about 11.1 mm, and where the jar neck comprises a 53-415 GPI/SPI Neck Finish.

In a second aspect, a jar and lid combination comprises a jar body comprising a jar bottom, a jar sidewall, having a front area and a back area, a jar neck with a first set of threads, a jar body rim, and a jar body alignment point, where the first set of threads has a first starting point and a first ending point, and where the first starting point and the first ending point are in a defined alignment relationship to the jar body alignment point, and where the jar front area is in a defined alignment relationship to the jar body alignment point, and where the jar front area includes jar front printed information, and a jar lid comprising a ring with a vertical portion and a horizontal portion, where the vertical portion has an interior vertical surface and the interior vertical surface has a second set of threads having a second starting point and a second ending point, and where the ring has a first ring alignment point, and where the first ring alignment point is in a defined alignment relationship to the second staring point and the second ending point, an interior edge, positioned radially inward of the vertical portion, where the interior edge forms an aperture in the horizontal portion, a window pane, at least a portion of which is comprised of a translucent material, where the window pane has a first window alignment point, and where the window pane has printed information that is oriented in a defined relationship to the first window alignment point, and where the window pane is affixed to the vertical portion such that the window pane obstructs the aperture, and further such that the first window alignment point is in a defined alignment relationship with the first ring alignment point, and where the jar lid may be secured to the jar neck by engagement of the first set of threads and the second set of threads, such that when the jar lid is secured, there is a defined alignment relationship between and among the jar alignment point, the jar front printed information, the first set of threads, the second set of threads, the first ring alignment point, the first window alignment point, and the window printed information, such that the window printed information is aligned with jar front printed information.

In an embodiment of the second aspect, the first ring alignment point is on the horizontal portion of the ring.

In another embodiment of the second aspect, the first ring alignment point is on the vertical portion of the ring.

In another embodiment of the second aspect, the first ring alignment point is a depression in the vertical portion of the ring.

In another embodiment of the second aspect, the first ring alignment point is a detent projection and the first window alignment point is a detent depression.

In another embodiment of the second aspect, the first ring alignment point is one or more flattened projections, and the first window alignment point is a flattened land, whereby one or more flattened projections engage the flattened land to position the window in alignment with respect to the second threads.

In another embodiment of the second aspect, the ring further comprises a second ring alignment point in a defined alignment relationship to the second staring point and the second ending point, and a second window alignment point in a defined relationship to the second ring alignment point, where the jar lid may be secured to the jar neck by engagement of the first set of threads and the second set of threads, such that when the jar lid is secured, there is a defined alignment relationship between and among the jar alignment point, the jar front printed information, the first set of threads, the second set of threads, the first ring alignment point, the first window alignment point, the second ring alignment point, the second window alignment point, and the window printed information, such that the window printed information is aligned with jar front printed information.

In another embodiment of the second aspect, the jar alignment point is on the jar bottom.

In another embodiment of the second aspect, the jar body has an interior volume of between about 0.5 fluid ounces and 5 fluid ounces.

In another embodiment of the second aspect, the dimensions of the jar neck comprise a "T" dimension of about 51.29 mm, an "E" dimension of about 49.6 mm, an "I" dimension of about 46.39 mm, an "S" dimension of about 1.45 mm; an "H" dimension of about 11.1 mm, and where the jar neck comprises a 53-415 GPI/SPI Neck Finish.

In a third aspect, a method is provided for making a jar with a lid having a window pane, such that printed information on the front of the jar is in alignment printed information on the window pane when the lid is secured to the jar, the method comprising, making a jar body comprising a jar bottom, a jar sidewall, having a front area and a back area, a jar neck with a first set of threads, a jar body rim, and a jar body alignment point, where the first set of threads has a first starting point and a first ending point, where the first starting point and the first ending point are in a defined alignment relationship to the jar alignment point, where the jar front area is in a defined alignment relationship to the jar alignment point, printing first product information on the front area of the jar, making a jar lid ring comprising a vertical portion and a horizontal portion, where the vertical portion has an interior vertical surface and the interior vertical surface has a second set of threads having a second starting point and a second ending point, where the ring has a first ring alignment point, where the first ring alignment point is in a defined alignment relationship to the second staring point and the second ending point, an interior edge, positioned radially inward of the vertical portion, where the interior edge forms an aperture in the horizontal portion, making a jar lid window, at least a portion of which is comprised of a translucent material, where the jar lid window has a first window alignment point, printing second product information on the jar lid window, where the product information is printed in a defined relationship to the first window alignment point, affixing the jar lid window to the jar lid ring where the jar lid window is affixed to the vertical portion such that the jar lid window obstructs the aperture, and further such that the first window alignment point is in a defined alignment relationship with the first ring alignment point, and such that when the jar body is filled with a product, the jar lid may be secured to the jar neck by engagement of the first set of threads and the second set of threads, and further such that when the jar lid is secured, there is a defined alignment relationship between and among the jar alignment point, the jar front printed information, the first set of threads, the second set of threads, the first ring alignment point, the first window alignment point, and the window printed information, such that the window printed information is aligned with jar front printed information.

In an embodiment of the third aspect, the first ring alignment point is a depression in the vertical portion of the ring.

In another embodiment of the third aspect, the first ring alignment point is a detent projection and the first window alignment point is a detent depression.

In another embodiment of the third aspect, the dimensions of the jar neck comprise a "T" dimension of about 51.29 mm, an "E" dimension of about 49.6 mm, an "I" dimension of about 46.39 mm, an "S" dimension of about 1.45 mm; an "H" dimension of about 11.1 mm, and where the jar neck comprises a 53-415 GPI/SPI Neck Finish.

BRIEF DESCRIPTION OF THE DRAWINGS

In the descriptions that follow, like parts or steps are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein.

DETAILED DESCRIPTION OF THE EMBODIMENTS

The present embodiments disclose and describe a windowed jar lid that may be threadably attached to a jar, such that powder or liquid contained in the jar does not leak through the threads or window, and further such that a logo printed on the window is properly aligned with the front of the jar when the windowed jar lid is threadably attached and securely closed on the jar. The embodiments disclosed herein are intended to be instructional and not limiting to the scope of the claims, except where specifically set forth. Moreover, while the description focuses on a jar for use with a cosmetic powder, such a jar could be useful for many different kinds of product packaging.

Figure 1A:
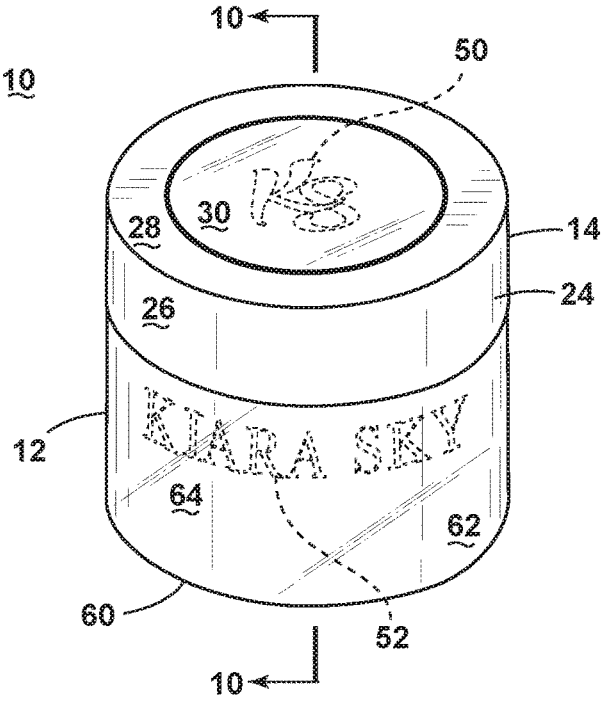
FIG. 1A illustrates a front perspective view of an embodiment of the present jar with a windowed lid, with the lid securely tightened on the jar.
Figure 1B:
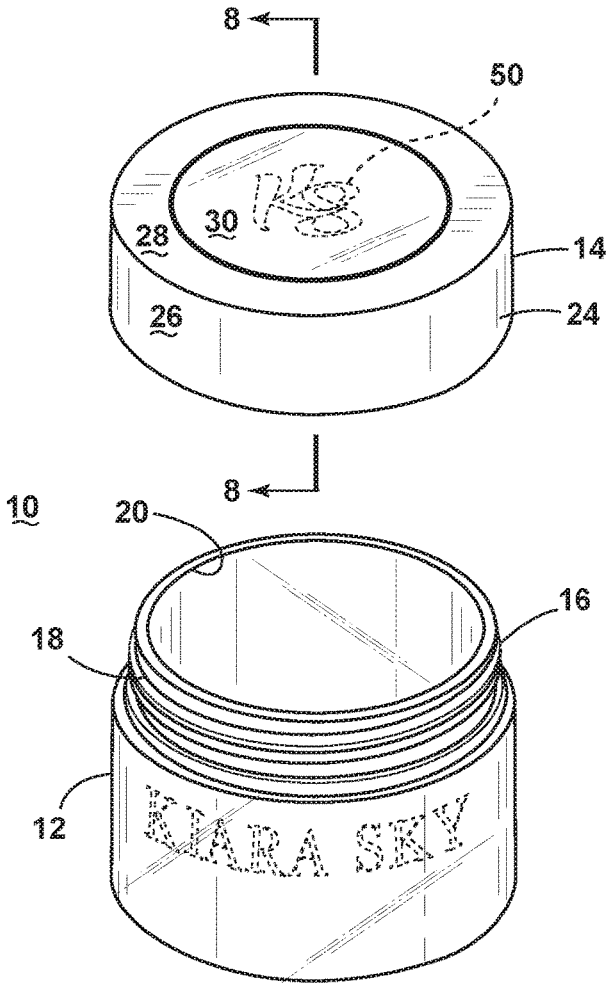
FIG. 1B illustrates a front perspective view the jar of FIG. 1A, with the windowed lid removed from the jar.
Figure 2:
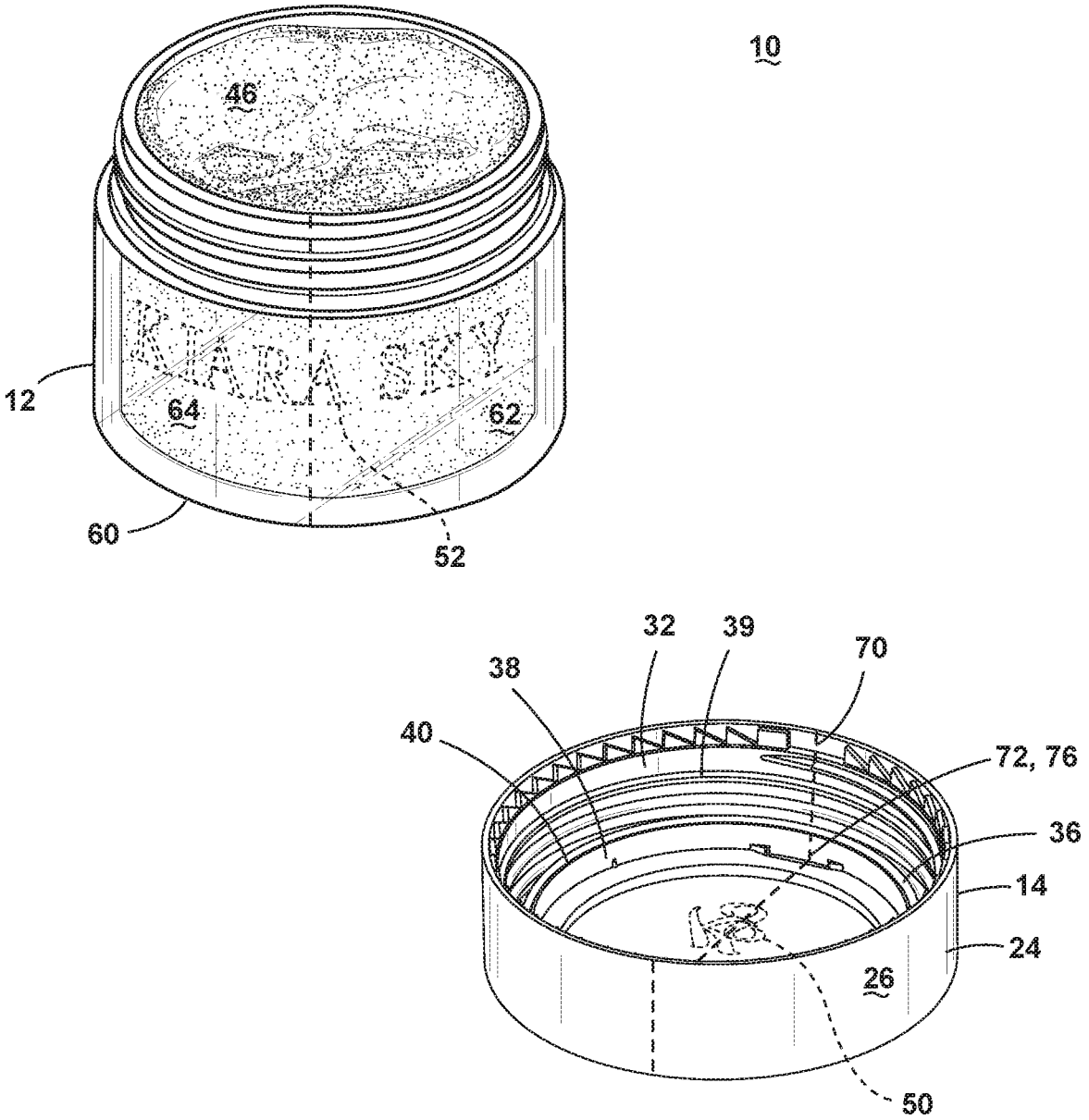
FIG. 2 illustrates the jar of FIG. 1A, with the jar filled with a fine cosmetic powder, and the lid removed and inverted.
Figure 3:
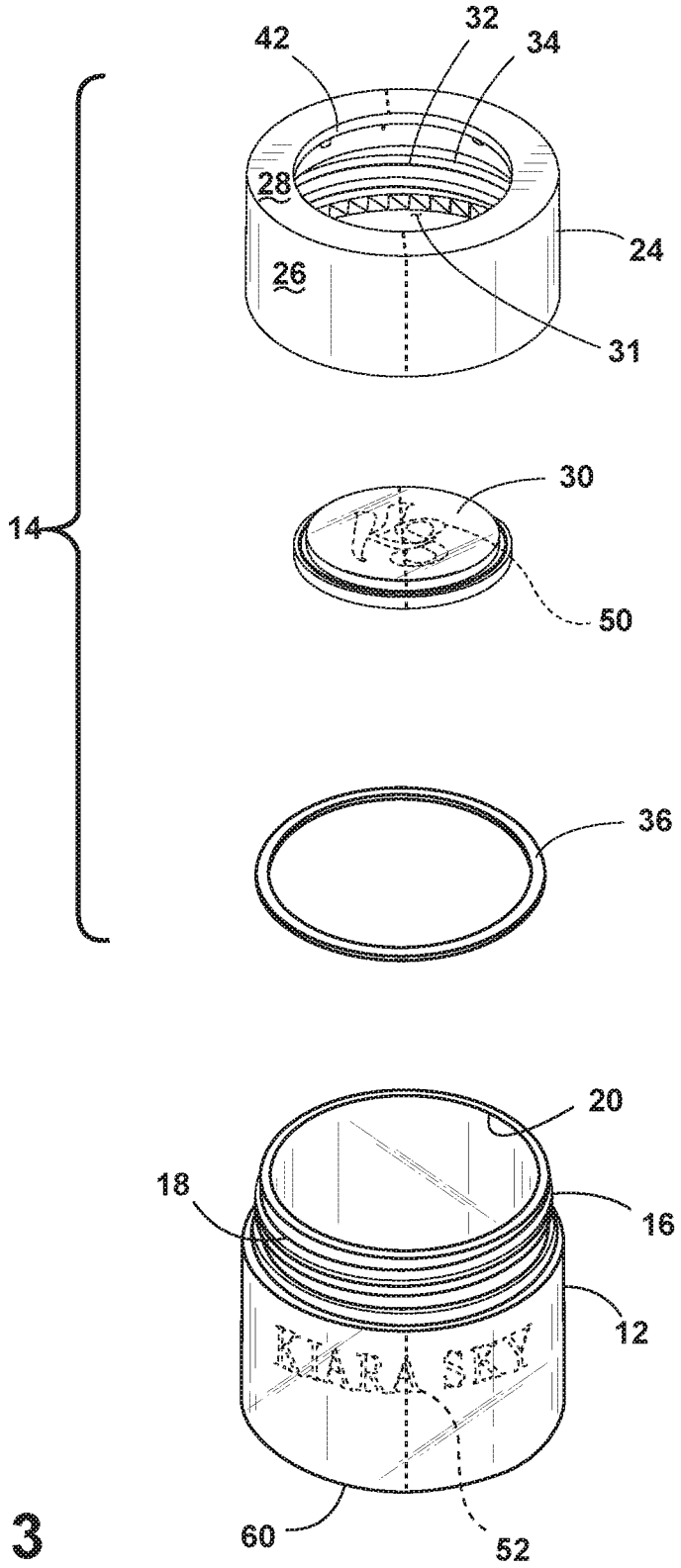
FIG. 3 illustrates an exploded front perspective view of the jar of FIG. 1A.

With respect to FIGS. 1A and 1B, a combination jar and windowed jar lid 10 is illustrated. The embodiment includes a jar body 12 and a windowed jar lid 14. The jar body 12 is may be translucent, or preferably, transparent. For example, the jar body 12 may be made from glass, or from a translucent or transparent plastic substance, such as acrylonitrile styrene ("AS"). The jar body 12 has a jar neck 16 with a first set of threads 18 and a jar body rim 20. The windowed jar lid 14 may be threadably secured to the jar body 12.

With reference to FIGS. 2, 3, and 5-10, the jar lid 14 includes a ring 24 with a vertical portion 26 and a horizontal portion 28. The jar lid 14 also includes a window pane 30 affixed to the ring 24 that serves to close an aperture 31 in the ring 24. The vertical portion 26 has an interior surface 32 with a second set of threads 34. The jar lid 14 also includes a liner 36, placed in contact with an interior surface 38 of the horizontal portion 28. The liner 36 is positioned radially inward of the vertical portion 26. The liner 36 may be made of any number of materials that will enable the liner 36 to securely contact the jar body rim 20. The liner 36 may be made of paper. The liner 36 may also be of a plastic, such as polyethylene. In a preferred embodiment, the liner 36 is made of a low density polyethylene foam. In a further preferred embodiment, the liner 36 has a thickness of 0.65 mm, with a variance of +/−0.1 mm.

The ring 24 also includes an interior wall 38, projecting downwardly from the horizontal portion 28, and positioned radially inward of the liner 36. The interior wall 38 has a rim 40. The interior wall 38 may project downward at approximately a ninety (90) degree angle with the horizontal portion 28. However, it should be understood that the angle of the interior wall 38 to the horizontal portion 28 may be otherwise, so long as the rim 40 reaches a plane that is below the plane of the jar body rim 20 when the jar lid 14 is threadably secured onto the jar body 12.

The ring 24 has an interior edge 42, positioned radially inward of the interior wall 38. The interior edge 42 forms the aperture 31 in the horizontal portion 28. The window pane 30 is affixed to the horizontal portion 28, such that the window pane 30 obstructs the aperture 31 and will prevent powder or liquid from passing through the aperture 31. The window pane 30 is at least partially translucent. In a preferred embodiment, the window pane 30 is transparent. For example, the window pane 30 may be made from a translucent or transparent plastic substance, such as acrylonitrile styrene ("AS"). The window pane 30 is affixed to the ring 24. Preferably, this is accomplished by laser welding. However, other methods of fixation may be used, such as ultrasonic welding, or an adhesive such as cyanoacrylate. In certain embodiments, the horizontal portion 28 of the ring 24 has a ledge 44 positioned radially inward of the interior wall 38. The ledge 44 serves as a surface to which the window pane 30 can be affixed to the ring 24. In another embodiment, the window pane 30 has a circumference, and the aperture 31 has a circumference, and the circumference of the window pane 30 is larger than the circumference of the aperture 31. This difference in circumferences can improve the ability to affix the window pane 30 to the ring 24.

While the aperture 31, window pane 30, liner are shown as generally circular or annular, the shape of the aperture 31 and window pane 30 are not limited. So long as the jar lid 14 may be threadably secured to the jar body 12, the aperture 31 and window pane 30, may be any desirable shape. Possible shapes include an oval, a square, a rectangle, a polygon of any number of sides, a letter, or a symbol, so long as the window pane 30 may be firmly affixed to the ring 24 and the aperture 31 is obstructed so that fine powder may not pass through it.

In use, the jar lid 14 may be secured to the jar neck 16 by engagement of the first set of threads 18 and the second set of threads 34, until the liner 36 is securely contacted by the jar body rim 20 and the rim 40 of the interior wall 38 is positioned below the jar body rim 20. In the embodiments disclosed herein, the liner 36, interior wall 38, and affixed window pane 30 cooperate to prevent leakage of fine powder 46, such as acrylic nail dipping powder, from leaking through the aperture 31 or the engaged threads, when the jar lid 14 is threadably secured to the jar body 12. As a result, it is neither necessary, nor desirable, to include a sealing layer covering the jar between the jar rim and the jar lid in order to prevent leakage of fine loose powders such as cosmetics.

While not limiting, the jar and windowed lid combination may have an interior volume of between about 0.5 fluid ounces and 5 fluid ounces. In a preferred embodiment, the interior volume is 2 fluid ounces.

Figure 11:
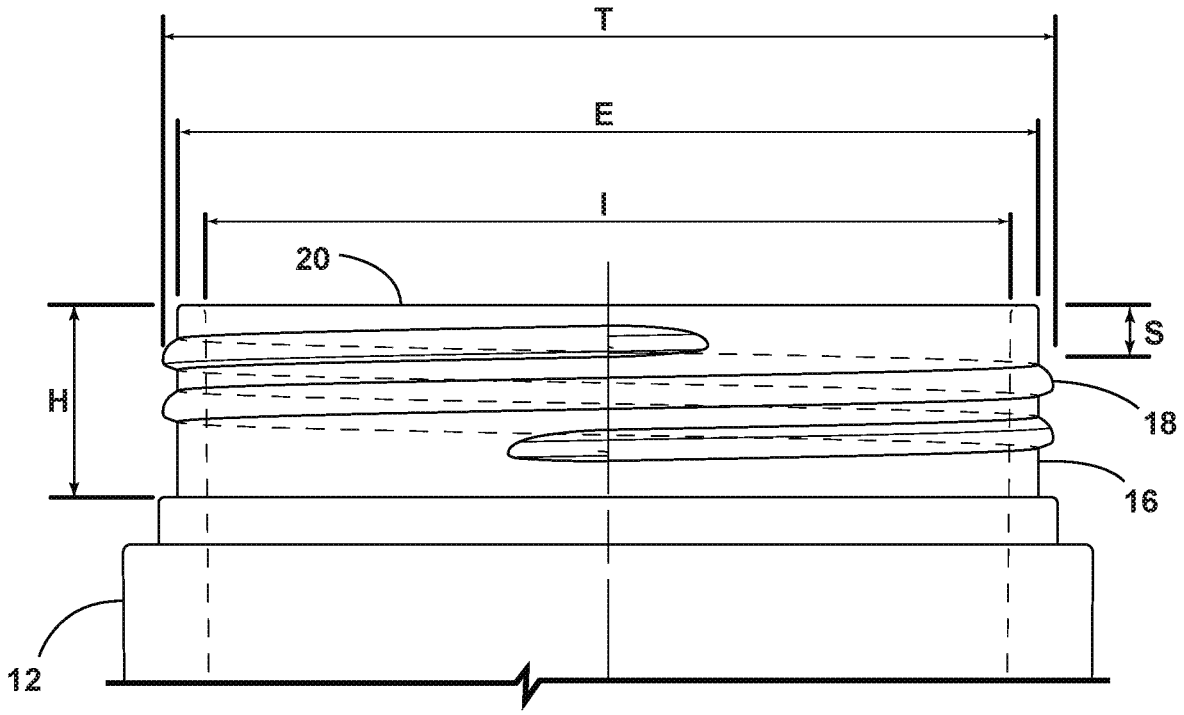
FIG. 11 is a cut-away side view of one embodiment of the jar neck, with dimensions for industry standard points of measurement, namely the "T", "E", "I", "S", and "H" dimensions.

Further, while not limiting, as illustrated in FIG. 11, exemplary dimensions of the jar body and jar neck are a "T" dimension of about 51.29 mm, an "E" dimension of about 49.6 mm, an "I" dimension of about 46.39 mm, an "S" dimension of about 1.45 mm; an "H" dimension of about 11.1 mm, and a jar neck with a 53-415 GPI/SPI Neck Finish.

In another aspect of the embodiments disclosed herein, Applicant has invented structures and methods for ensuring that a logo 50 on the top of the window pane 30 is properly oriented with respect to the printed information 52 on the front area 64 of the jar, when the jar lid 14 is threadably secured to the jar body 12. These embodiments and methods address, among other things, the problem of a logo 50 on a jar lid window pane being "crooked" with respect to the printed information 52 on the front area 64 of the jar body 12, due to the need to rotate the jar lid 14 as the threads of the jar lid 14 and the threads 18 of the jar neck 16 are engaged to achieve a tight closure of the jar lid 14 to the jar body 12.

Figure 4:
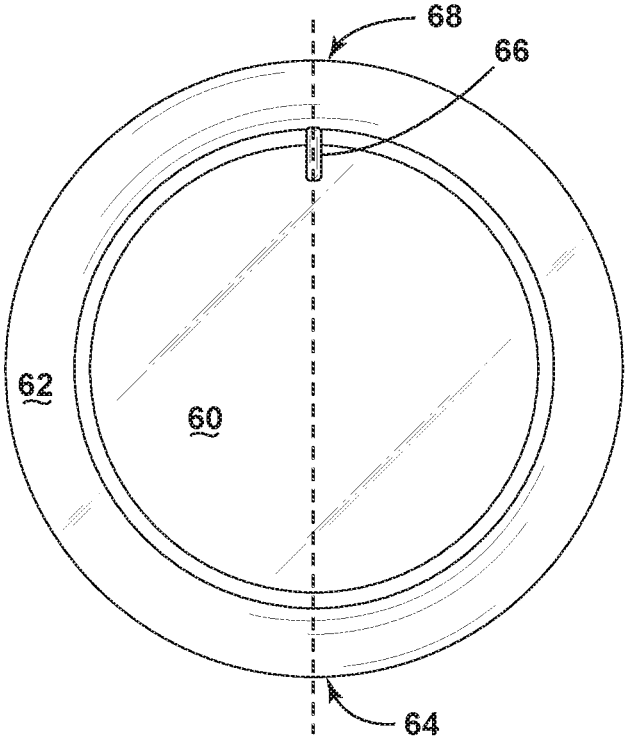
FIG. 4 illustrates a bottom view of the jar of FIG. 1A.
Figure 5:
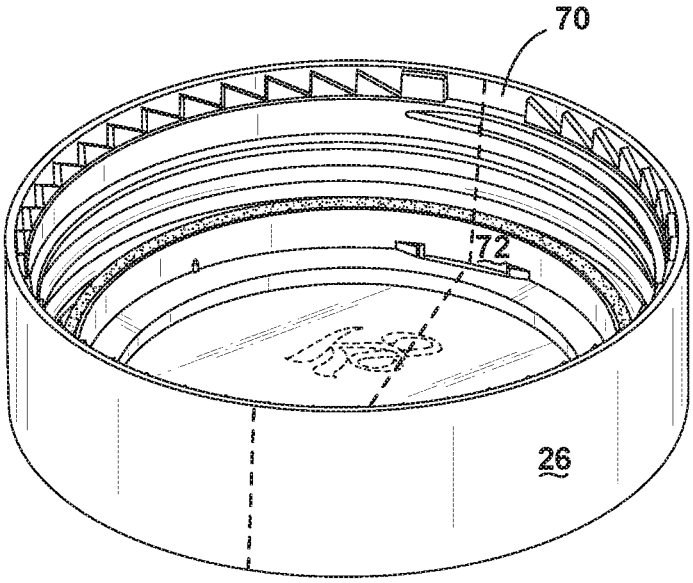
FIG. 5 illustrates a perspective view of an embodiment of windowed lid, in an inverted position.

With reference to the Figures generally, and FIG. 4 particularly, the jar body 12 has a jar bottom 60 and ajar sidewall 62. The jar sidewall 62 has a front area 64 and a back area 68. The jar neck 16 has a first set of threads 18 and a jar body rim 20, which are in a defined and known alignment with a jar body alignment point 66. In the embodiments shown, the jar body alignment point 66 is a projecting tab on the jar bottom 60. However, the jar body alignment point 66 could also be an indentation. Moreover, the jar body alignment point 66 can also be positioned at any convenient and/or aesthetically pleasing location on the jar body 12. The jar body alignment point 66 must be in a known alignment relationship to the first set of threads 18. The first set of threads 18 has a first starting point and a first ending point. The jar body alignment point 66 is thus in a known alignment relationship with the first starting point and the first ending point. In the disclosed embodiments, the known alignment relationship is that the jar body alignment point 66 is 180 degrees radially away from an average point between the first starting point and the first ending point. Put another way, the jar body alignment point 66 is along an imaginary sectional line (10-10) that bisects the jar body 12 and bisects the average point between the first starting point and the first ending point. However this disclosed known alignment relationship is exemplary and should not be construed as limiting.

The jar front area 64 includes jar front printed information 52. The jar front printed information 52 may be the name of the product contained in the jar body 12, a company logo, or other such identification and branding information. As illustrated, the jar front printed information 52 is the trademark KIARA SKY®, which is the registered trademark of Glam and Glits Nail Design, Inc. The KIARA SKY® trademark may be reproduced in this patent application with permission, however all other rights are reserved. The jar front printed information 52 is in a defined alignment relationship to the jar body alignment point 66. As explained above, in the disclosed embodiments, the known alignment relationship is that the jar body alignment point is 180 degrees radially away from the center line of the jar front area 64 and the jar front printed information 52 is centered on that center line. Put another way, the jar body alignment point 66 is along an imaginary sectional line (10-10) that bisects the jar body 12 and bisects both the jar front area 64 and the jar front printed information 52. However this disclosed known alignment relationship is exemplary and should not be construed as limiting.

Similarly, the jar lid 14 has defined alignment relationships. The jar lid 14 has a ring 24 with a vertical portion 26 and a horizontal portion 28, where the vertical portion 26 has an interior vertical surface 32 and the interior vertical surface 32 has a second set of threads 34 having a second starting point and a second ending point. The ring 24 also has a first ring alignment point 70. The first ring alignment point 70 is in a known or defined alignment relationship to the second staring point and the second ending point of the second set of threads 34. The ring 24 also has an interior edge 42 positioned radially inward of the vertical portion 26, where the interior edge 42 forms an aperture 31 in the horizontal portion 28. Inserted into the aperture 31, and affixed to the horizontal portion 28 is a window pane 30, at least a portion of which is of a translucent material. Preferably, the entire window pane 30 is of a transparent material, such as AS, as described above.

As explained herein, when a jar body 12 is made with a jar alignment point 66, with a defined relationship between and among the jar alignment point 66 and the starting and ending points on the threads 18 on the neck 16 of the jar body 12 and the printed information 52 on the front area 64 of the jar body 12, and a windowed lid 14 is made a ring 24 and a window pane 30, and with at least one ring alignment point 70, 72, 74, and there is a defined or known relationship between and among the ring alignment point(s) 70, 72, 74 and the starting and ending points of the threads 34 on the interior vertical surface 32 of the ring 24, and the orientation of a logo 50 on the window pane 30 (or the orientation of the window pane 30 on which a logo 50 has been or will be printed), and a mechanical device can identify these various alignment points and orient the jar body 12 for printing, and can assemble the jar lid ring 24 and window pane 30 such that the logo 50 is properly oriented, then a mechanized device can be used to fill the jar body 12, and then place the jar lid 14 on the jar body 12, and rotate the jar lid 14 until it is threadably secured on the jar body 12, and as a result, the logo 50 will be properly oriented with the printed information 52 on the front area 64 of the jar body 12. As further discussed herein, the various alignment points may be any known mechanical or opto-mechanically identifiable point, such as a projection, a detent projection, a depression, a detent depression, a slot, a tab, or a marker that is identifiable by machine vision.

Figure 6A:
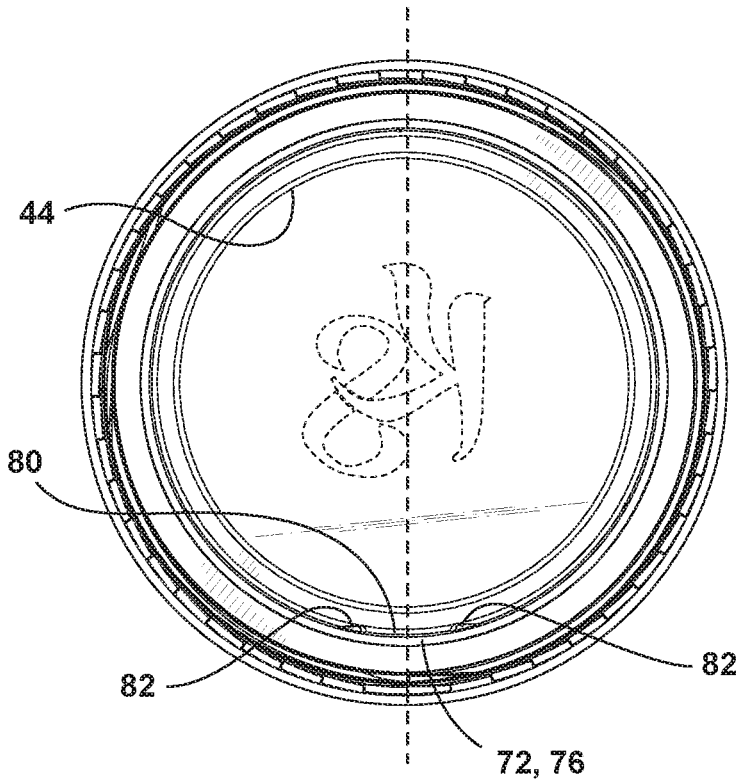
FIG. 6A illustrates a plan view of a first embodiment of the windowed lid, in an inverted position.
Figure 6B:
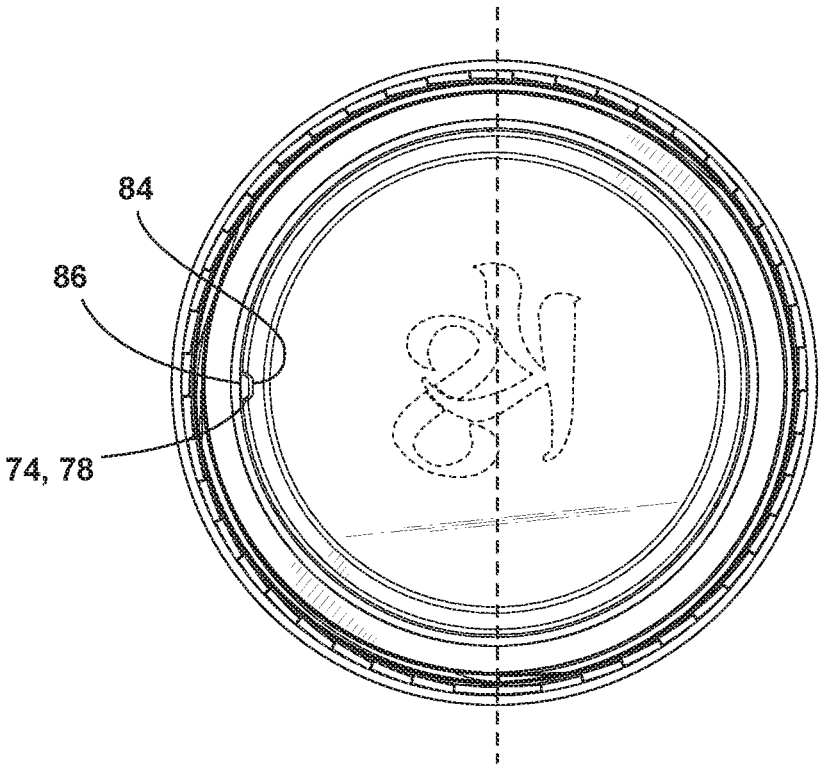
FIG. 6B illustrates a plan view of a second embodiment of the windowed lid, in an inverted position.
Figure 6C:
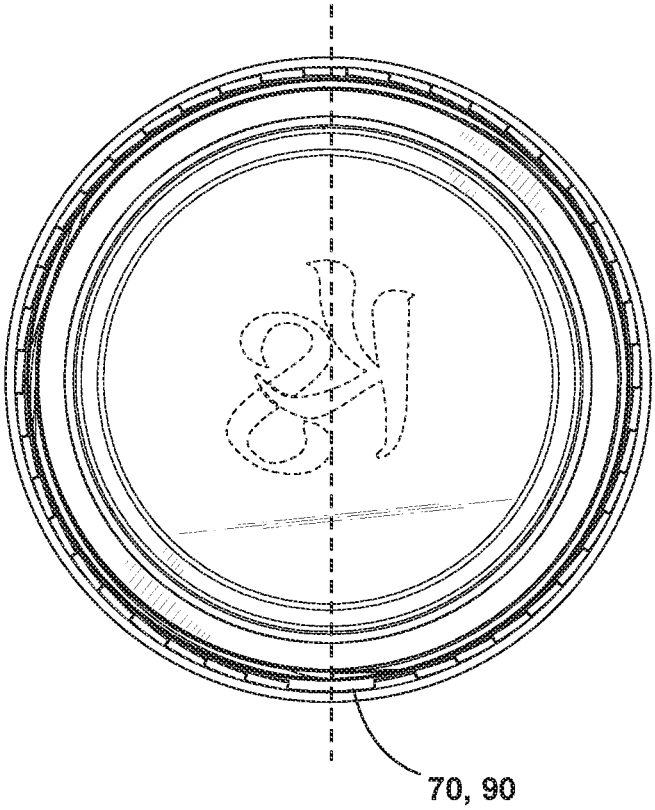
FIG. 6C illustrates a plan view of a third embodiment of the windowed lid, in an inverted position.

As illustrated in FIGS. 6A-6C, there are various different embodiments as to the placement of the at least one ring alignment point 70, 72, 74. Some embodiments of the window pane 30 also have a one or more window alignment points 76, 78. Some embodiments have a window pane 30 with no window alignment point. Each embodiment, and the method with which it is used, is discussed further as follows.

Figure 12:
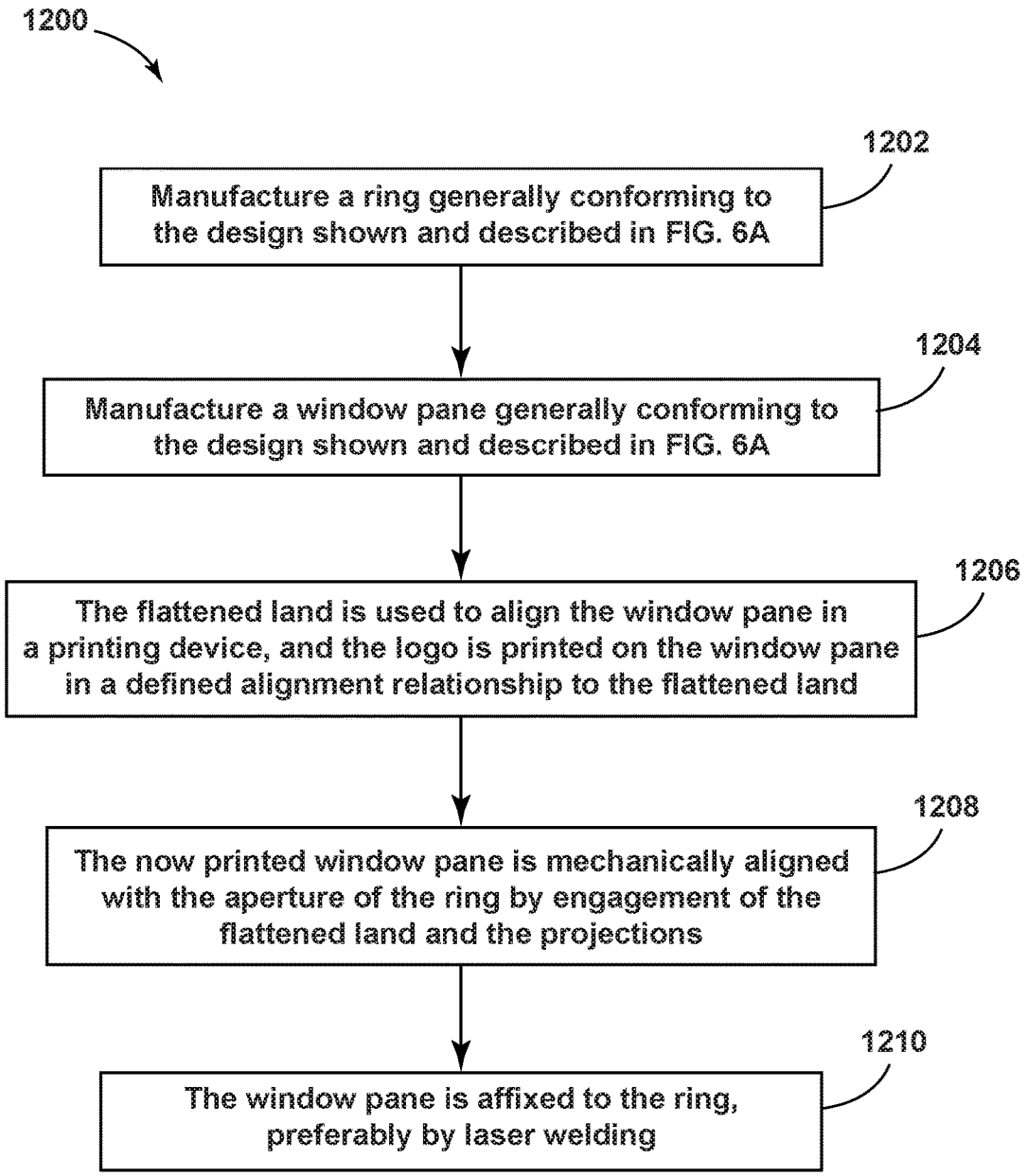
FIG. 12 is a flow chart for one embodiment of the manufacturing process of the jar with a windowed lid, to be used with the embodiment of the lid illustrated in FIG. 6A.

With reference to FIG. 6A, and FIG. 12, one embodiment of a jar lid 14 is disclosed. The embodiment includes a window pane 30 with a flattened land 80. The flattened land 80 is configured to engage with two projections 82 that project from the horizontal portion 28 of the ring 24. The flattened land 80 is configured to align the window pane 30 so that the window pane 30 will fit into the aperture 31 in only one rotational position. This combination of flattened land 80 and projections 82 serves as the window alignment point 76, and also serves as the ring alignment point 72. There is a defined alignment relationship between the window alignment point 76/ring alignment point 72 and the second set of threads 34. Specifically, in this embodiment, the window alignment point 76/ring alignment point 72 is along a line that bisects the starting and ending points of the second set of threads 34, and which bisects and correctly aligns the logo 50, and which, in turn, will bisect the jar body 12 through the jar alignment point 66. Thus, when the ring 24 is threadably secured to the jar body 12, there are defined alignment relationships as discussed herein which will properly orient the logo 50 to the front area 64 printed information 52.

With reference to FIG. 12, a method 1200 for making and using the jar ring 24 embodiment of FIG. 6A is illustrated. At step 1202, a ring 24 generally conforming to the design shown and described in FIG. 6A, is manufactured. At step 1204, a window pane 30 generally conforming to the design shown and described in FIG. 6A is manufactured. At step 1206, the flattened land 80 is used to align the window pane 30 in a printing device, and the logo 50 is printed on the window pane 30 in a defined alignment relationship to the flattened land 80. This printing step 1206 may be by any known printing, embossing or stamping method. At step 1208, the now printed window pane 30 is mechanically aligned with the aperture 31 of the ring 24 by engagement of the flattened land 80 and the projections 82. At step 1210, the window pane 30 is affixed to the ring 24, preferably by laser welding.

Figure 13:
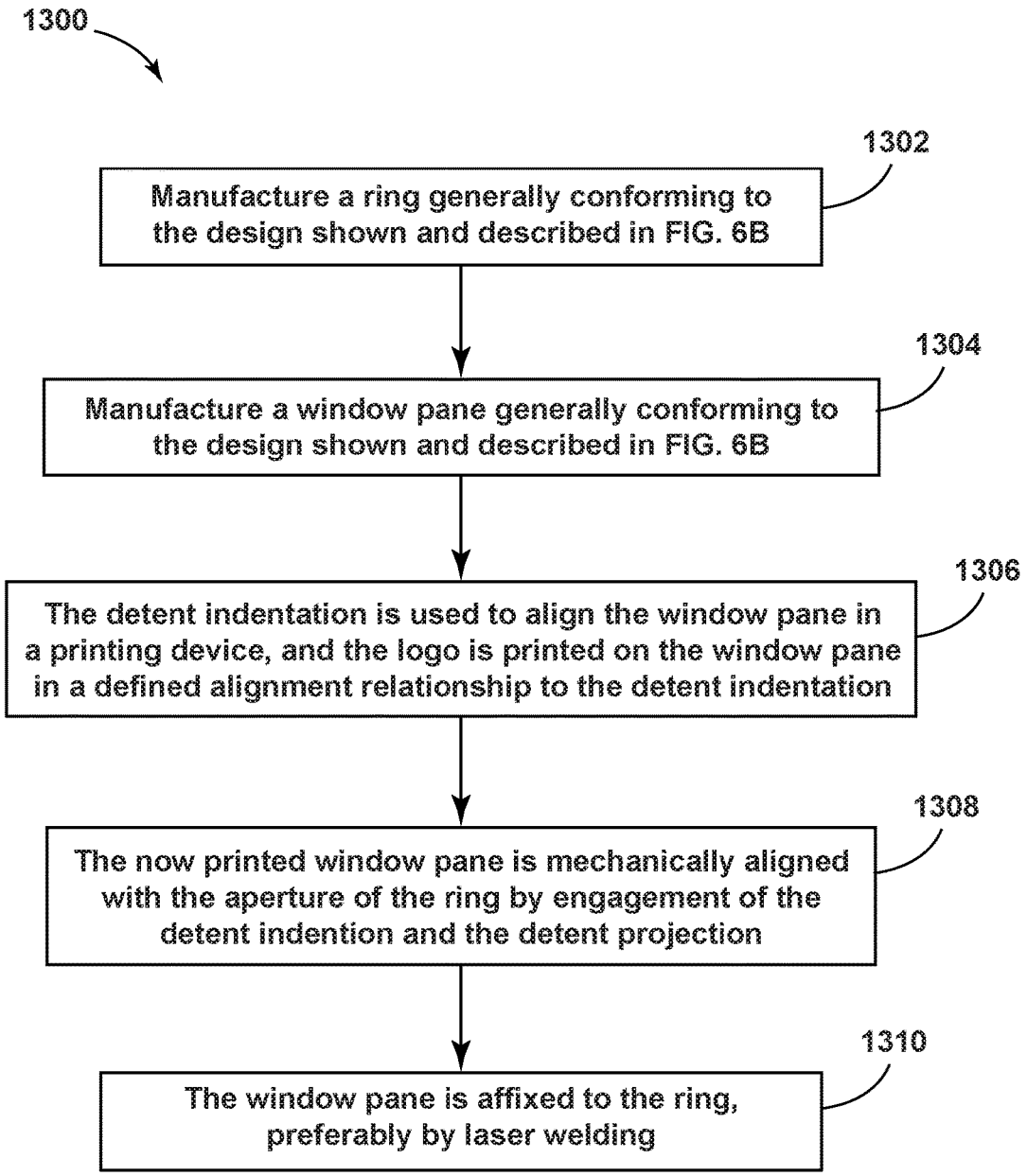
FIG. 13 is a flow chart for one embodiment of the manufacturing process of the jar with a windowed lid, to be used with the embodiment of the lid illustrated in FIG. 6B.

With reference to FIG. 6B, and FIG. 13, a window lid 14 structure with one ring alignment point 74, in a different configuration than that shown in FIG. 6A, and which also serves as a window alignment point 78, is illustrated, along with a method of manufacture of same. The embodiment includes a window pane 30 with a detent indentation 84. The detent indentation 84 is configured to engage with a detent projection 86 that projects from the horizontal portion 28 of the ring 24. The detent projection 86 is configured to align the window pane 30 so that the window pane 30 will fit into the aperture 31 in only one rotational position. This combination of detent indentation 84 and detent projection 86 serves as the window alignment point 78, and also serves as the ring alignment point 74. There is a defined alignment relationship between the window alignment point 78/ring alignment point 74 and the second set of threads 34. Specifically, in this embodiment, the window alignment point 78/ring alignment point 78 is rotationally positioned 90 degrees from a line that bisects the starting and ending points of the second set of threads 34, and which bisects and correctly aligns the logo 50, and which, in turn, will bisect the jar body 12 through the jar alignment point 66. Thus, when the ring 24 is threadably secured to the jar body 12, there are defined alignment relationships as discussed herein which will properly orient the logo 50 to the front area 64 printed information 52. This embodiment also serves to illustrate that different defined alignment relationships can exist (e.g., bisecting, or 90 degrees offset from a bisecting line), so long as the alignment relationships are known and defined.

With reference to FIG. 13, a method 1300 for making and using the jar ring 24 embodiment of FIG. 6B is illustrated. At step 1302, a ring 24 generally conforming to the design shown and described in FIG. 6B, is manufactured. At step 1304, a window pane 30 generally conforming to the design shown and described in FIG. 6B is manufactured. At step 1306, the detent indentation 84 is used to align the window pane 30 in a printing device, and the logo 50 is printed on the window pane 30 in a defined alignment relationship to the detent indentation 84. This printing step 1306 may be by any known printing, embossing or stamping method. At step 1308, the now printed window pane 30 is mechanically aligned with the aperture 31 of the ring 24 by engagement of the detent indention 84 and the detent projection 86. At step 1310, the window pane 30 is affixed to the ring 24, preferably by laser welding.

Figure 14:
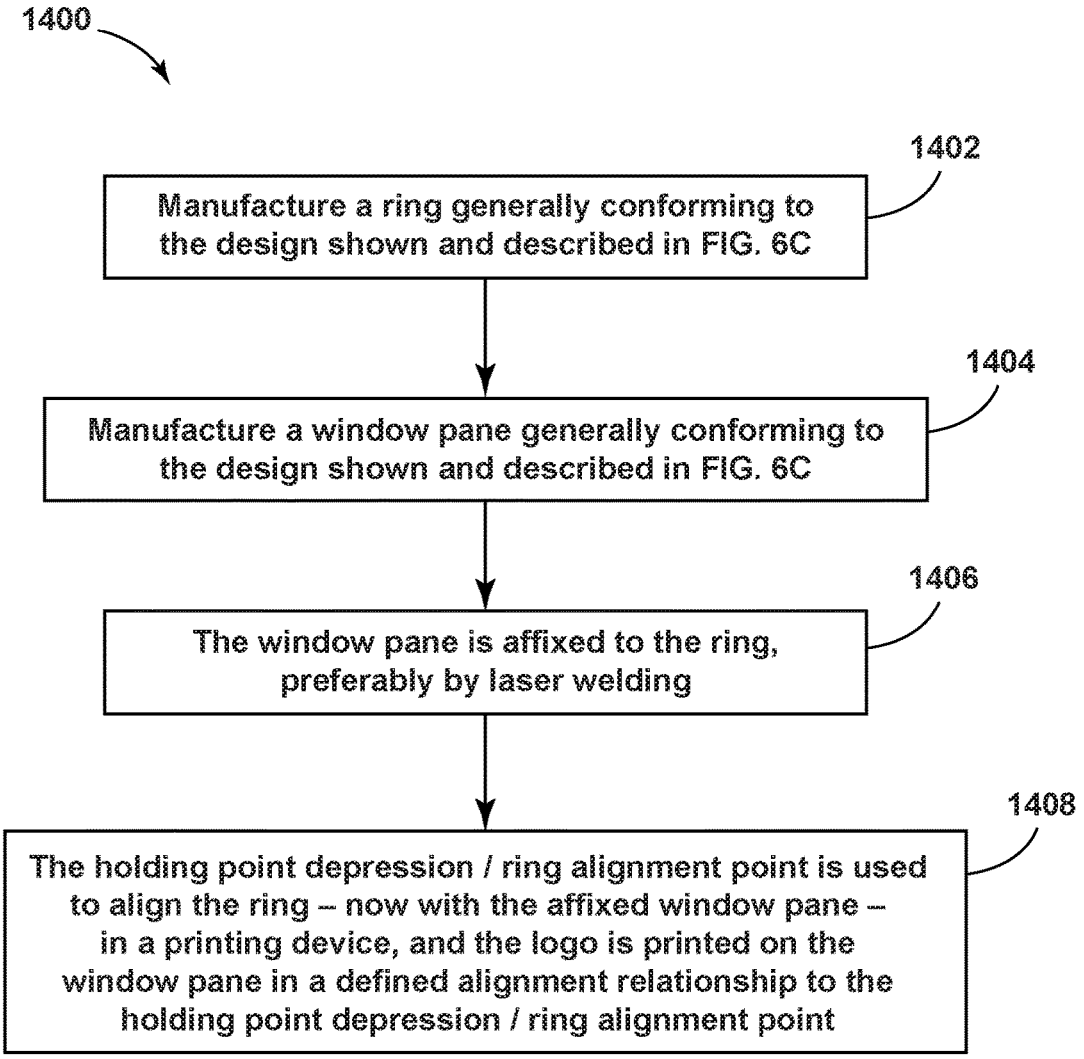
FIG. 14 is a flow chart for another embodiment of the manufacturing process of the jar with a windowed lid, to be used with the embodiment of the lid illustrated in FIG. 6C.

With reference to FIG. 6C, and FIG. 14, a window lid 14 structure with one ring alignment point 70, in a different configuration than that shown in FIG. 6A or 6B, is illustrated, along with a method of manufacture of same. The ring alignment point 70 of FIG. 6C also differs from the above-described embodiments in that it does not serve as a window alignment point, which is not needed for this embodiment. The embodiment includes a jar lid ring 24 with a holding point depression 90 on the interior surface 32 of the vertical portion 28. In other embodiments, the holding point depression 90 may be on the horizontal portion 26, or any other aesthetically pleasing location on the ring 24. It will also be understood that a projection or other structure could be used in place of the holding point depression 90, so long as it is able to be used for mechanical or opto-mechanical identification and orientation of the ring 24. The holding point depression 90 also serves as the ring alignment point 70. There is a defined alignment relationship between the holding point depression 90/ring alignment point 70 and the second set of threads 34. Specifically, in this embodiment, the holding point depression 90/ring alignment point 70 is bisected by a line that bisects the starting and ending points of the second set of threads 34, and which bisects and correctly aligns the logo 50, and which, in turn, will bisect the jar body 12 through the jar body alignment point 66. Thus, when the ring 24 is threadably secured to the jar body 12, there are defined alignment relationships as discussed herein which will properly orient the logo 50 to the front area 64 printed information 52.

With reference to FIG. 14, a method 1400 for making and using the jar ring 24 embodiment of FIG. 6C is illustrated. At step 1402, a ring 24 generally conforming to the design shown and described in FIG. 6C, is manufactured. At step 1404, a window pane 30 generally conforming to the design shown and described in FIG. 6C is manufactured. At step 1406, the window pane 30 is affixed to the ring 24, preferably by laser welding. At this stage, the orientation of the window pane 30 is immaterial, because it has not yet been printed with the logo 50. At step 1408, the holding point depression 90/ring alignment point 70 is used to align the ring 24—now with the affixed window pane 30—in a printing device, and the logo 50 is printed on the window pane 30 in a defined alignment relationship to the holding point depression 90/ring alignment point 70. This printing step 1408 may be by any known printing, embossing or stamping method.

In certain embodiments, such as shown in FIGS. 6A and 6B, the alignment relationship between the window alignment point and the ring alignment point may be that the window alignment point and the ring alignment point are the same point. In other embodiments, the window alignment point and the ring alignment point may be different points.

Figure 7:
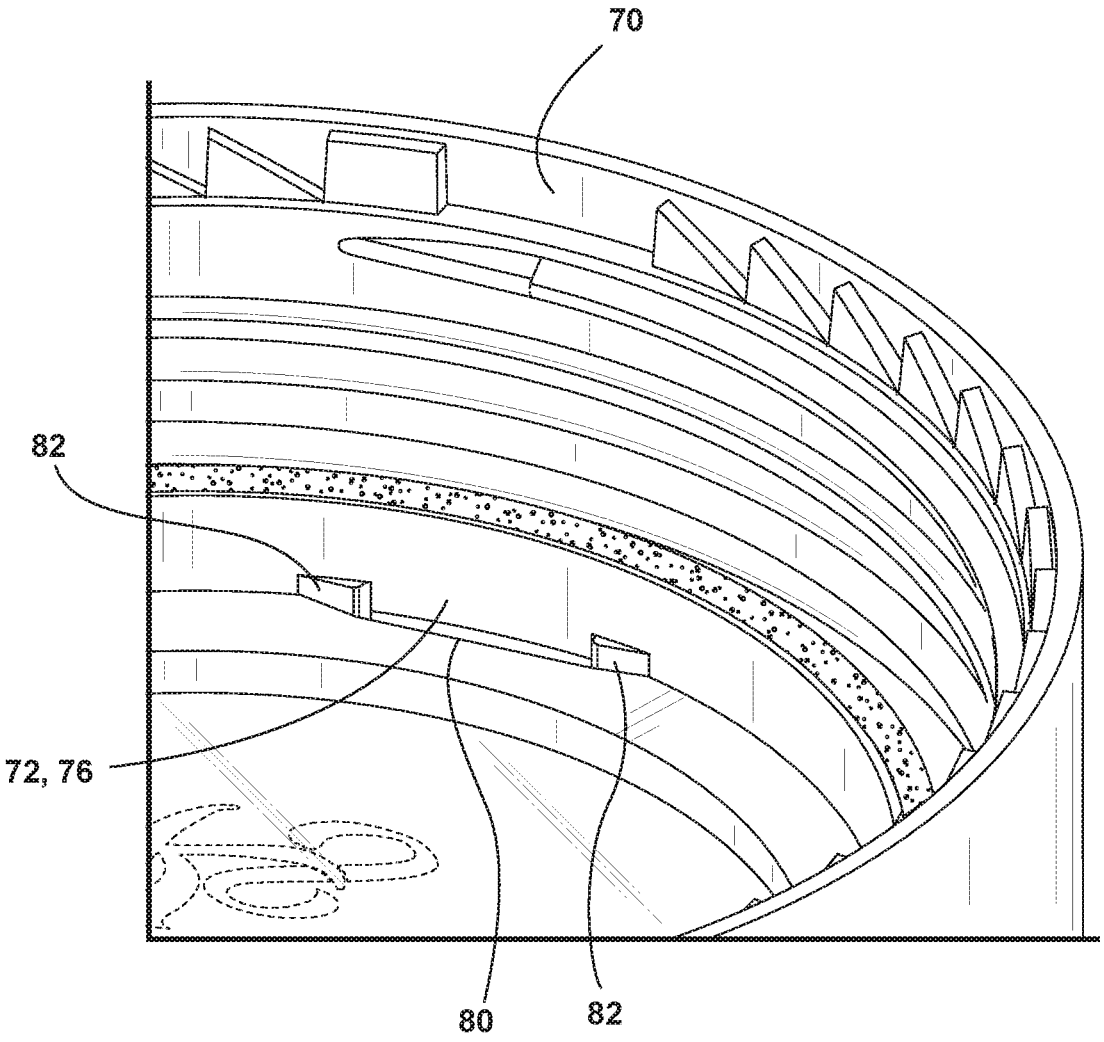
FIG. 7 illustrates a close-up perspective view of the windowed lid of FIG. 5.
Figure 8:
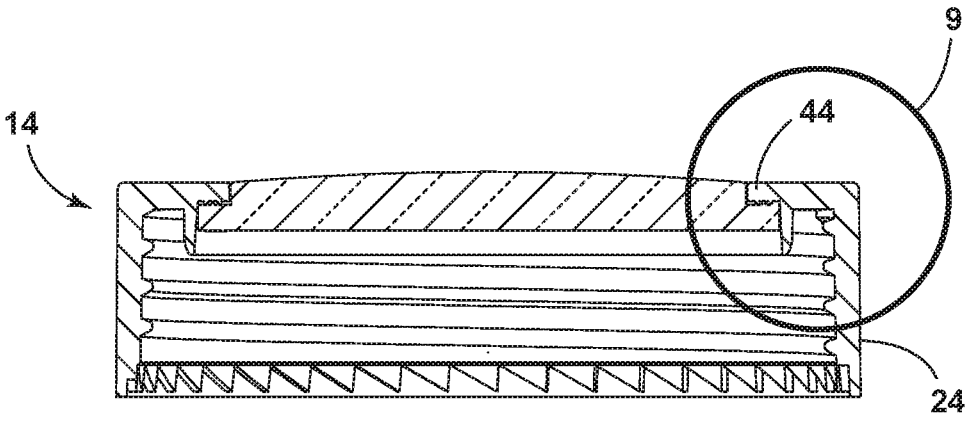
FIG. 8 illustrates a cross-sectional view of the windowed lid of FIG. 1B, along the sectioning line 8-8.
Figure 9:
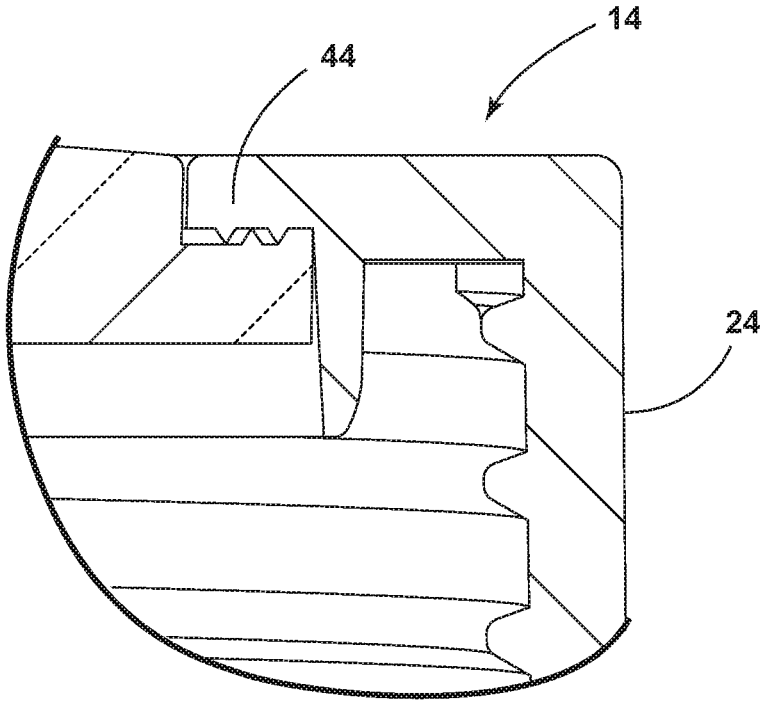
FIG. 9 illustrates a close-up of the portion of the cross-sectional view of the windowed lid that is encircled by circle 9.
Figure 10:
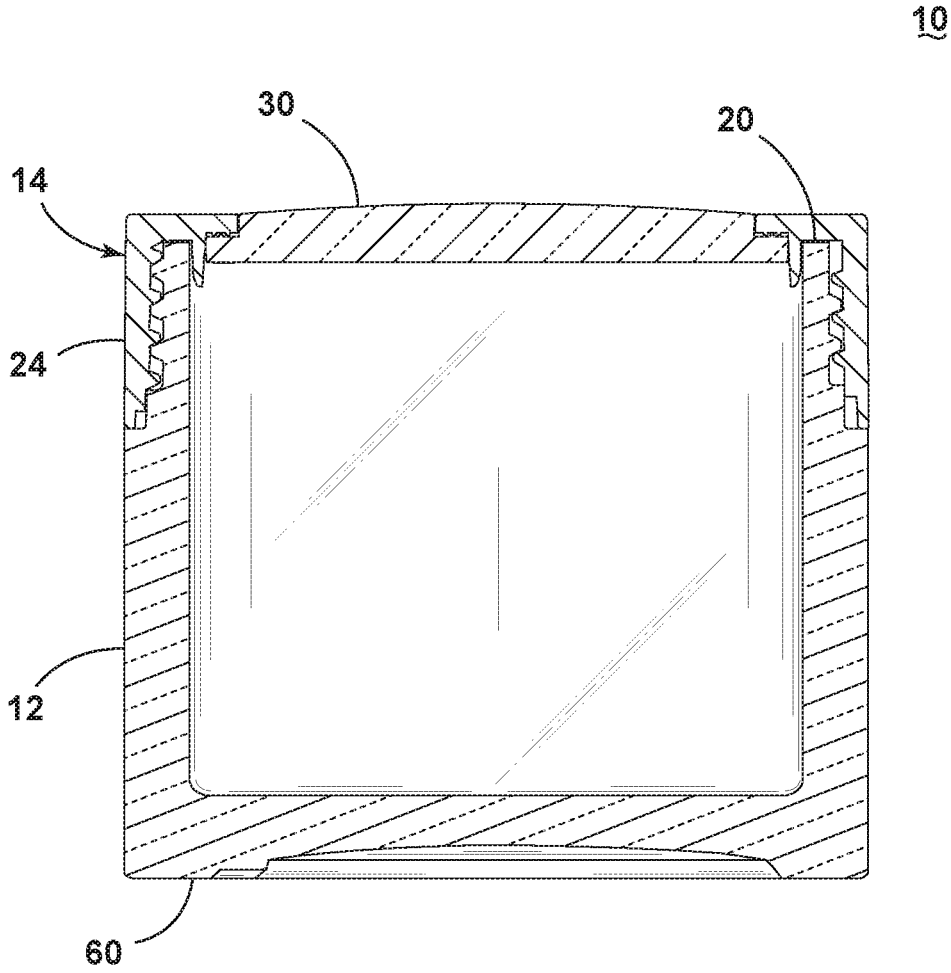
FIG. 10 illustrates a cross-sectional view of the jar and windowed lid of FIG. 1A, along the sectioning line 10-10.

In certain embodiments, such as shown in FIG. 7, it may be desirable and advantageous to have more than one ring alignment point, such as having a first ring alignment point 70 in the form of a holding point depression 90, and a second ring alignment point 72, in the form of a combination of flattened land 80 and projections 82.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments disclosed.

What is claimed is:

1. Ajar and lid combination comprising:

a jar body, wherein the jar body has a neck with a first set of threads and a jar body rim;

a jar lid comprising:

a ring with a vertical portion and a horizontal portion; wherein the vertical portion has an interior surface with a second set of threads;

a liner, placed in contact with an interior surface of the horizontal portion, and positioned radially inward of the vertical portion;

an interior wall, positioned on the horizontal portion and radially inward of the liner;

an interior edge, positioned radially inward of the interior wall, wherein the interior edge forms an aperture in the horizontal portion;

a window pane, at least a portion of which is comprised of a translucent material, wherein the window pane is affixed to the horizontal portion, such that the window pane obstructs the aperture;

wherein the jar lid may be secured to the jar neck by engagement of the first set of threads and the second set of threads, such that the liner contacts the jar rim and at least a portion of the interior wall is positioned below the jar rim.

2. The jar and lid combination of claim 1, wherein the window pane is comprised of a transparent material.

3. The jar and lid combination of claim 1, wherein the jar body is comprised of a transparent material.

4. The jar and lid combination of claim 1, wherein the jar body is comprised of acrylonitrile styrene ("AS"), and the wherein the window pane is comprised of AS.

5. The jar and lid combination of claim 1, wherein the horizontal portion of the jar lid further comprises a ledge positioned radially inward of the interior wall, and wherein the window pane is affixed to the ledge.

6. The jar and lid combination of claim 1 wherein the aperture is generally circular, the window pane is generally circular, the interior wall is generally annular, and the liner is generally annular.

7. The jar and lid combination of claim 1 wherein the aperture is generally oval and the window pane is generally oval.

8. The jar and lid combination of claim 1 wherein the window is affixed to the interior surface by a laser weld.

9. The jar and lid combination of claim 1 wherein the window is affixed to the interior surface by an adhesive.

10. The jar and lid combination of claim 1 wherein the liner is comprised of paper.

11. The jar and lid combination of claim 1 wherein the liner is comprised of polyethylene.

12. The jar and lid combination of claim 11 wherein the liner is comprised of low density polyethylene foam.

13. The jar and lid combination of claim 1 wherein the window pane has a circumference, the aperture has a circumference, and wherein the circumference of the window pane is larger than the circumference of the aperture.

14. The jar and lid combination of claim 1 wherein the combination does not include a sealing layer covering the jar between the jar rim and the jar lid.

15. The jar and lid combination of claim 1 wherein the jar body has an interior volume of between about 0.5 fluid ounces and 5 fluid ounces.

16. The jar and lid combination of claim 1 wherein the dimensions of the jar neck comprise:

a "T" dimension, measured as the outside diameter of the first set of threads, wherein the "T" dimension is about 51.29 mm;

an "E" dimension, measured as the outside diameter of the jar neck, wherein the "E" dimension is about 49.6 mm;

an "I" dimension, measured as the inside diameter of the jar neck, wherein the "I" dimension is about 46.39 mm;

an "S" dimension, measured as the distance between the rim of the jar neck and the starting point of the first set of threads, wherein the "S" dimension about 1.45 mm; and an "H" dimension, measured as the distance between the rim of the jar neck and a shoulder of the jar body, wherein the "H" dimension is about 11.1 mm.

17. A method of making a cosmetic jar, the method comprising:

making a jar body wherein the jar body has a neck with a first set of threads and ajar body rim;

making a jar lid ring comprising:

a ring with a vertical portion and a horizontal portion;

wherein the vertical portion has an interior surface with a second set of threads;

a liner, placed in contact with an interior surface of the horizontal portion, and positioned radially inward of the vertical portion;

an interior wall, positioned on the horizontal portion and radially inward of the liner;

an interior edge, positioned radially inward of the interior wall, wherein the interior edge forms an aperture in the horizontal portion;

making a jar lid window, at least a portion of which is comprised of a translucent material;

affixing the jar lid window to the jar lid ring such that the jar lid window obstructs the aperture; and wherein the jar lid may be secured to the jar neck by engagement of the first set of threads and the second set of threads.

18. The method of claim 17 wherein the jar lid window is affixed to the jar lid ring by laser welding.

19. The method of claim 17 wherein the jar lid window is affixed to the jar lid ring by adhesive.

20. The method of claim 17 wherein the jar lid window is affixed to the jar lid ring by ultrasonic welding.

21. The method of claim 17 further comprising:

filling the jar body with a cosmetic product; and securing the jar lid to the jar neck by engagement of the first set of threads and the second set of threads, such that the liner contacts the jar rim and at least a portion of the interior wall is positioned below the jar rim.

22. The method of claim 21 wherein the cosmetic product is a powder.

23. The method of claim 21 wherein the cosmetic product is a cream.

24. The method of claim 21 wherein the method does not include the step of sealing the jar rim with a separate sealing layer prior to securing the jar lid to the jar neck.

* * * * *